US008079679B2

(12) United States Patent
Naruse et al.

(10) Patent No.: US 8,079,679 B2
(45) Date of Patent: Dec. 20, 2011

(54) IMAGE FORMING APPARATUS

(75) Inventors: Shinichiro Naruse, Fujisawa (JP); Takayuki Niihara, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 560 days.

(21) Appl. No.: 12/271,044

(22) Filed: Nov. 14, 2008

(65) Prior Publication Data

US 2009/0136258 A1 May 28, 2009

(30) Foreign Application Priority Data

Nov. 22, 2007 (JP) ..... 2007-302627

(51) Int. Cl.
*B41J 2/175* (2006.01)

(52) U.S. Cl. ..... 347/85

(58) Field of Classification Search ..... 347/85, 347/84, 86–87
See application file for complete search history.

(56) References Cited

U.S. PATENT DOCUMENTS

| | | | | |
|---|---|---|---|---|
| 4,684,962 | A * | 8/1987 | Hirosawa et al. | 347/85 |
| 6,929,358 | B2 * | 8/2005 | Matsuzaki et al. | 347/85 |
| 7,261,399 | B2 * | 8/2007 | Miki | 347/85 |
| 2005/0146554 | A1 | 7/2005 | Asanuma et al. | |
| 2005/0194730 | A1 | 9/2005 | Nishida et al. | |
| 2006/0146106 | A1 | 7/2006 | Naruse | |
| 2006/0209104 | A1 | 9/2006 | Naruse | |
| 2006/0268053 | A1 | 11/2006 | Naruse | |
| 2007/0126787 | A1 | 6/2007 | Naruse | |

FOREIGN PATENT DOCUMENTS

| | | |
|---|---|---|
| JP | 2006-205741 | 8/2006 |
| JP | 2006-240039 | 9/2006 |
| JP | 2007-168403 | 7/2007 |
| JP | 2007-245349 | 9/2007 |

* cited by examiner

*Primary Examiner* — Kristal Feggins
(74) *Attorney, Agent, or Firm* — Cooper & Dunham LLP

(57) ABSTRACT

An image forming apparatus includes a carriage, a plurality of sub-tanks, a main tank, and a plurality of supply tubes. The carriage includes a plurality of recording heads that jet liquid droplets of a plurality of colored ink. The plurality of sub-tanks supply the plurality of recording heads with the corresponding colored ink. The main tank supplies the corresponding colored ink to each of the sub-tanks. The plurality of supply tubes connect the main tank and the sub-tanks. The plurality of supply tubes are fused in a band-shape at a position between the main tank and the carriage, and a maximum of two of the supply tubes are fused together at a position corresponding to a groove of a tube fixing unit provided to the carriage.

9 Claims, 8 Drawing Sheets

IMAGE FORMING APPARATUS

CROSS-REFERENCE TO RELATED APPLICATIONS

This application claims priority under 35 U.S.C. §119(a) to Japanese Patent Application No. 2007-302627, filed on Nov. 22, 2007 in the Japan Patent Office, the entire contents of which are hereby incorporated by reference herein.

BACKGROUND OF THE INVENTION

1. Field of the Invention

The present disclosure generally relates to an image forming apparatus including a recording head for jetting liquid droplet(s) and a sub-tank for supplying ink to the recording head.

2. Description of the Background Art

An image forming apparatus such as a printer, a facsimile machine, a copier, or a multi-functional device thereof may include a liquid jetting device including a recording head configured as, for example, a liquid jetting head for jetting liquid droplet(s) of a recording liquid (e.g., ink). Such image forming apparatuses jet liquid droplet(s) from nozzles of the liquid jetting head to form an image on a recording medium (hereinafter "sheet" or "sheets").

Such image forming apparatuses can be categorized into two types. One type is a serial-type image forming apparatus, in which a recording head jets liquid droplet(s) while moving the recording head in a main scanning direction to form an image on a recording sheet. The other type is a line-type image forming apparatus, in which a line-type recording head extending in a width direction of a recording sheet jets liquid droplet(s) without moving the recording head to form an image.

In either case, such an image forming apparatus using a liquid jetting method includes a carriage including a sub-tank, and a main tank installed in a housing of the image forming apparatus. The sub-tank (or head tank, buffer tank) stores a relatively small amount of ink to be supplied to a recording head, and the main tank (or main cartridge, ink cartridge) stores a relatively large amount of ink to be supplied to the sub-tank. The main tank is connected to the sub-tank by a supply tube having some flexibility.

Conventionally, image forming apparatuses having an ink supply unit using such a sub-tank arrangement have been devised as below.

For example, JP-2006-240039-A discloses an image forming apparatus including a head carriage having a plurality of liquid sub-tanks, a plurality of liquid main tanks storing a plurality of recording inks, and a liquid supply unit for supplying liquid from the liquid main tank to the liquid sub-tanks. The plurality of liquid main tanks are provided and fixed in the image forming apparatus separately from the head carriage. The liquid supply unit and the plurality of liquid sub-tanks in the head carriage are connected by a plurality of liquid supply tubes. The liquid supply tubes are arranged and fixed together so that the liquid supply tubes form a sheet-like shape as a whole. The liquid supply tubes may be called a liquid supply tube band.

JP-2007-168403-A discloses another image forming apparatus including a head carriage and a carriage cover. The head carriage includes a joint unit to which a plurality of ink supply tubes, arranged in a horizontal direction, are connected. The head carriage is slidably supported on a plain face, which extends from the joint unit in the same direction in which the ink supply tubes are extending (e.g., horizontal direction).

The carriage cover, provided at an upper part of the head carriage, includes a holding member for holding the ink supply tubes extending in the horizontal direction.

JP-2007-245349-A discloses yet another image forming apparatus including a recording head for jetting ink from nozzle(s) to record an image, an ink supply unit for supplying ink to the recording head, and a pressure member for applying pressure to the supply tubes, wherein the pressure member is pivotable.

JP-2006-205741-A discloses still another image forming apparatus including a plurality of ink tubes for supplying ink to a recording head, in which the ink tubes are arranged side-by-side and bundled together by an ink tube bundle member.

Although a plurality of supply tubes can be integrated in the sheet-like form, or can be integrated by the holding member, the bundle member, or the pressure member as above discussed, such configurations may become complex configurations. In view of such complexity, another configuration illustrated in FIG. 1 may be used, for example, in which a carriage 510 includes a tube fixing unit 512 having a groove 513. The groove 513 has a width D1 that is smaller than a tube diameter D of one supply tube (D1<D). A plurality of supply tubes 501*a* to 501*e* are arranged and fused together as an integrated supply tubes. Such integrated supply tubes can be called a supply tube band. The supply tubes 501*a* to 501*e* are fixed in the tube fixing unit 512 by pushing the supply tube band in the groove 513.

However, as illustrated in FIG. 2, when a plurality of supply tubes (e.g., five supply tubes) are arranged and fused side-by-side in a band-shape, for example, some supply tube (s) may be deviated from other supply tube(s) due to imprecise fusing. If such a deviation occurs, a width D2 of the supply tube band may become greater than the tube diameter D of one supply tube (D2>D). If such a supply tube band is pushed into the groove 513 of the tube fixing unit 512 as illustrated in FIG. 2, the deviated supply tube(s) may be get snagged or torn at a corner of the tube fixing unit 512, by which the supply tube(s) may be damaged because the groove 513 has a diameter corresponded to the tube diameter D of one supply tube.

SUMMARY

An image forming apparatus includes a carriage, a plurality of sub-tanks, a main tank, and a plurality of supply tubes. The carriage includes a plurality of recording heads that jet liquid droplets of a plurality of colored ink. The plurality of sub-tanks supply the plurality of recording heads with the corresponding colored ink. The main tank supplies the corresponding colored ink to each of the sub-tanks. The plurality of supply tubes connect the main tank and the sub-tanks. The plurality of supply tubes are fused in a band-shape at a position between the main tank and the carriage, and a maximum of two of the supply tubes are fused together at a position corresponding to a groove of a tube fixing unit provided to the carriage.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
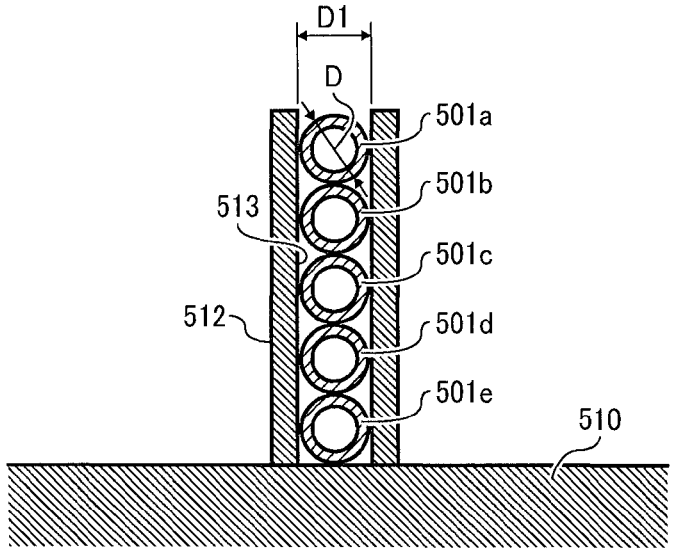
FIG. 1 BACKGROUND ART
FIG. 1 illustrates a cross-sectional view of supply tubes fit in a groove in a conventional manner.
Figure 2:
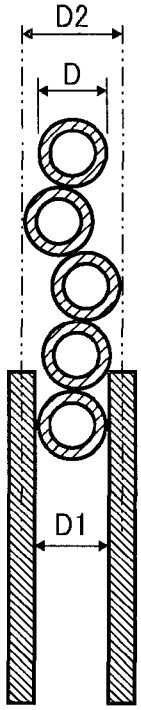
FIG. 2 BACKGROUND ART
FIG. 2 illustrates a cross-sectional view of supply tubes in a groove fit in a conventional manner, in which a positional deviation occurs among supply tubes.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing expanded views shown in the drawings, specific terminology is employed for the sake of clarity, the present disclosure is not limited to the specific terminology so selected and it is to be understood that each specific element includes all technical equivalents that operate in a similar manner.

The term "sheet" used herein refers to a medium, a recording medium, a recorded medium, a sheet material, a transfer material, a recording sheet, a paper sheet, or the like. The sheet may also be made of material such as paper, string, fiber, cloth, leather, metal, plastic, glass, timber, and ceramic, for example. Further, the term "image formation" used herein refers to providing, recording, printing, or imaging an image, a letter, a figure, a pattern, or the like onto the sheet.

Further, the-term "liquid" used herein is not limited to a recording agent or ink, and may include anything jetted in the form of a fluid. Hereinafter, such liquid may be simply referred to as "ink". Furthermore, the term "liquid jetting device" refers to a device for jetting liquid droplet(s) from a liquid jetting head to form an image, a letter, a figure, a pattern, or the like.

Referring now to the drawings, an image forming apparatus according to an exemplary embodiment is described with respect to FIGS. 3 to 6. The image forming apparatus may be an inkjet printer, for example, but is not limited thereto.

Figure 3:
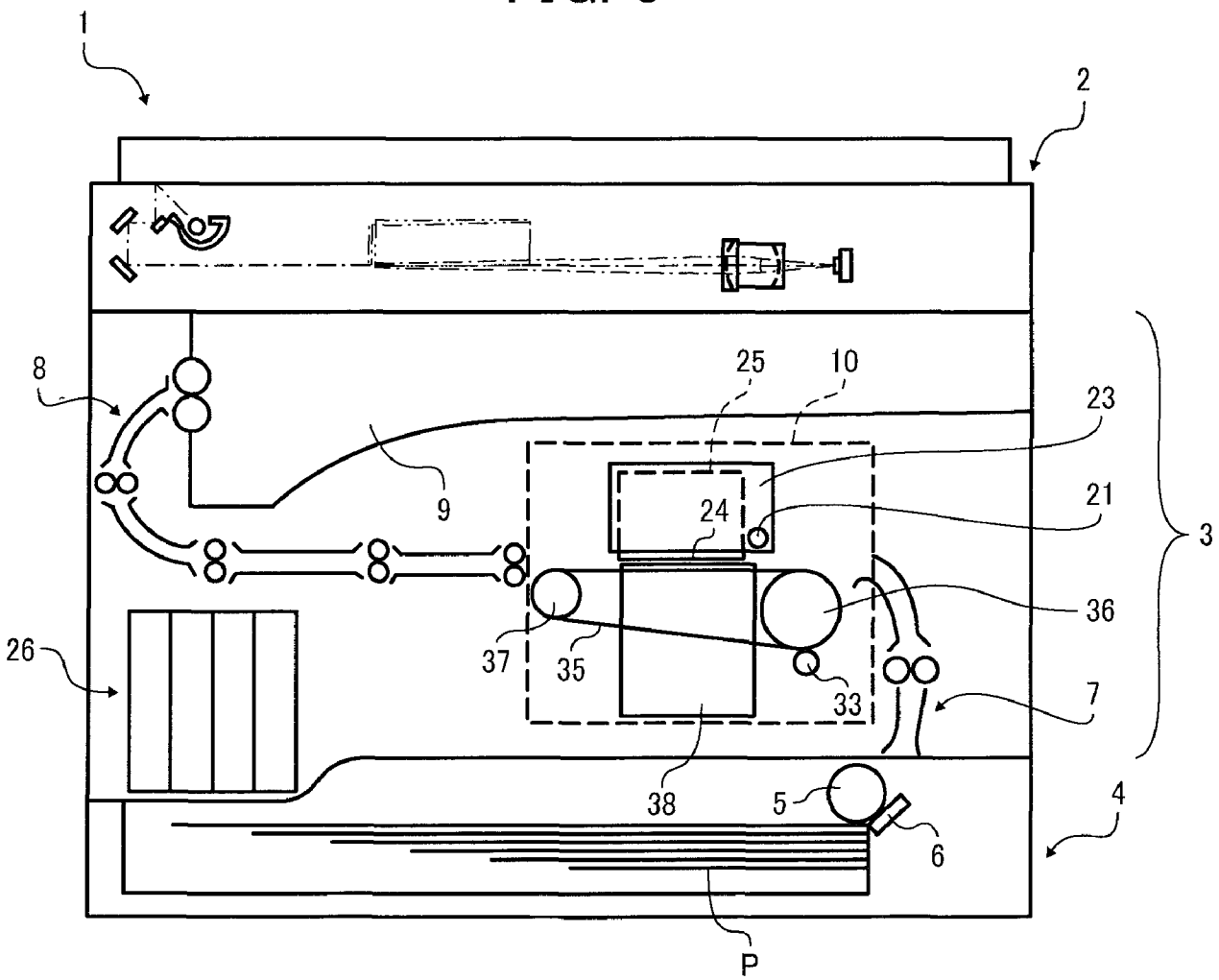
FIG. 3 illustrates a schematic configuration of an image forming apparatus according to an exemplary embodiment.
Figure 4:
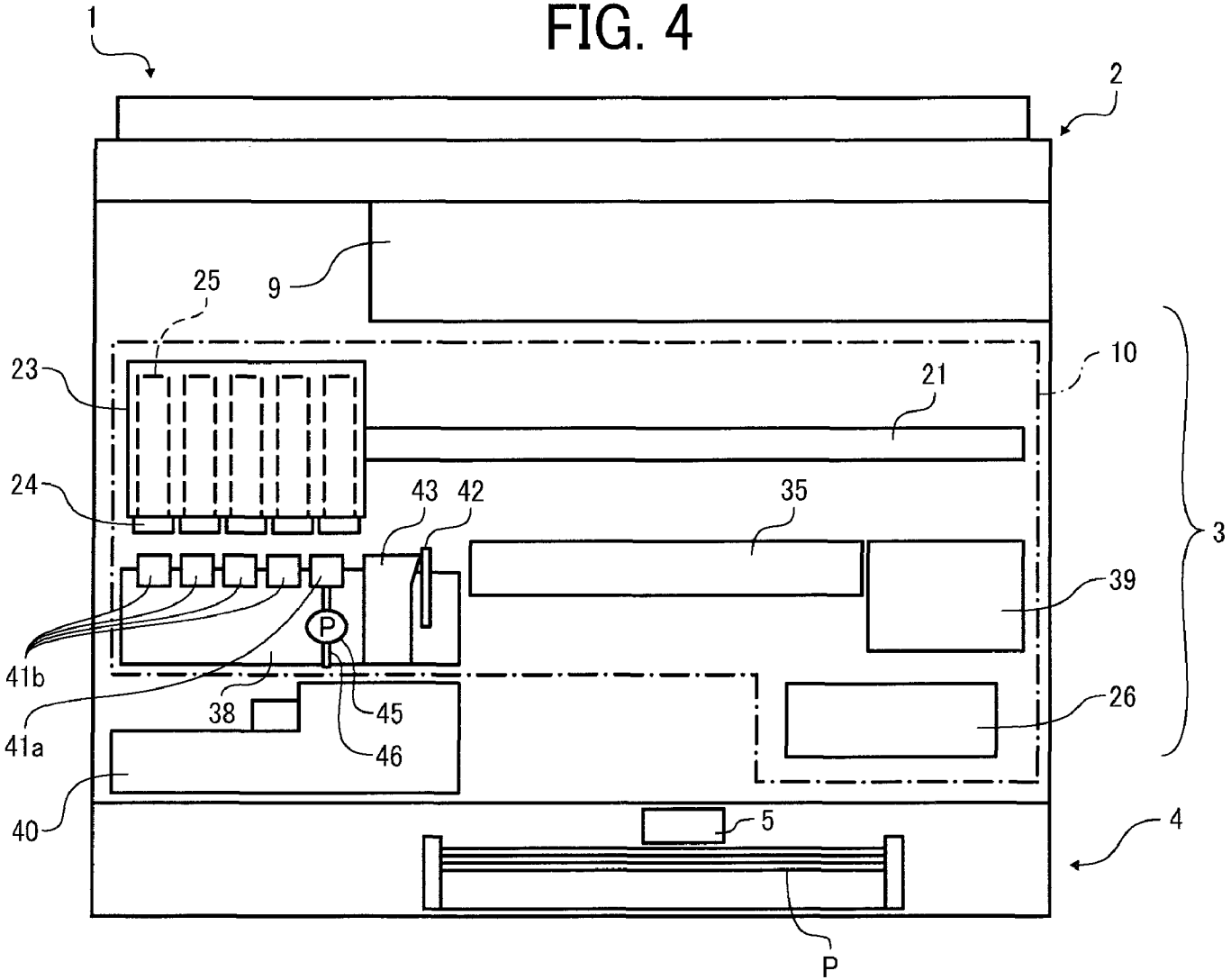
FIG. 4 illustrates a front view of the image forming apparatus of FIG. 3.
Figure 5:
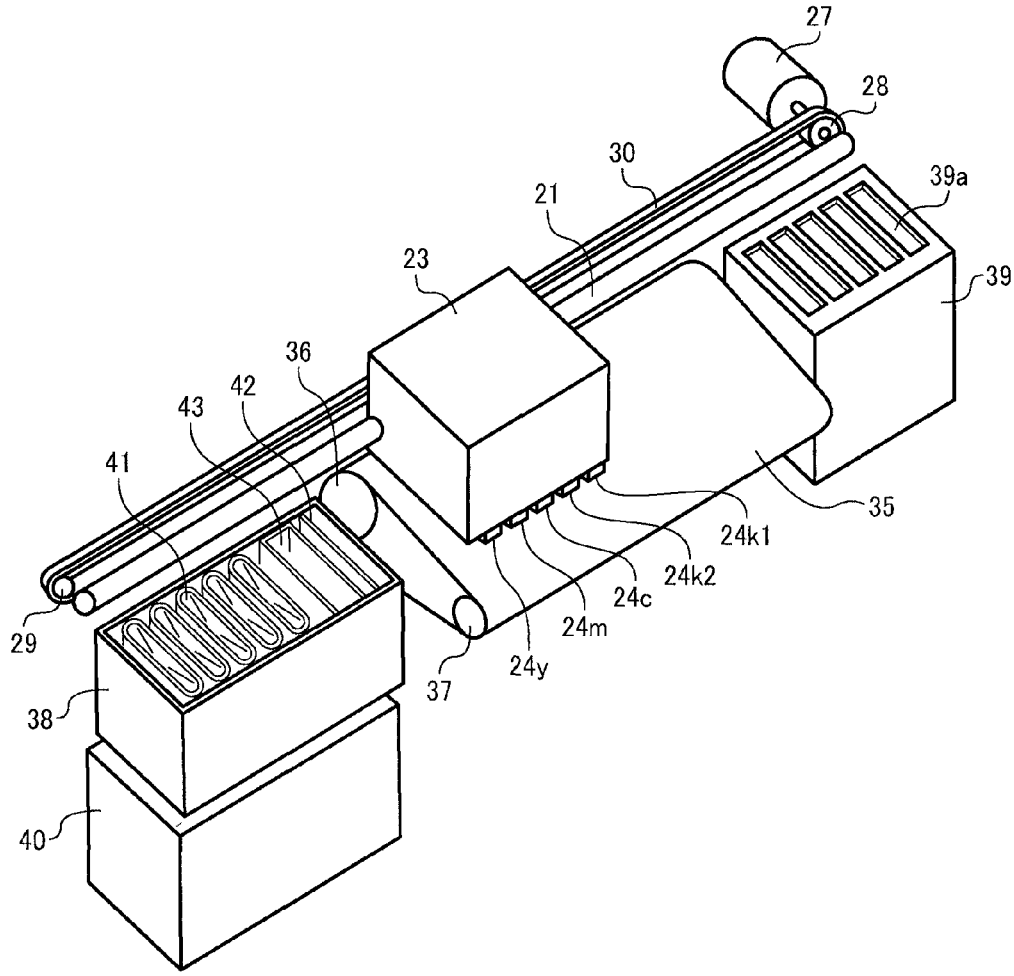
FIG. 5 illustrates a perspective view of a printing section of the image forming apparatus of FIG. 3.
Figure 6:
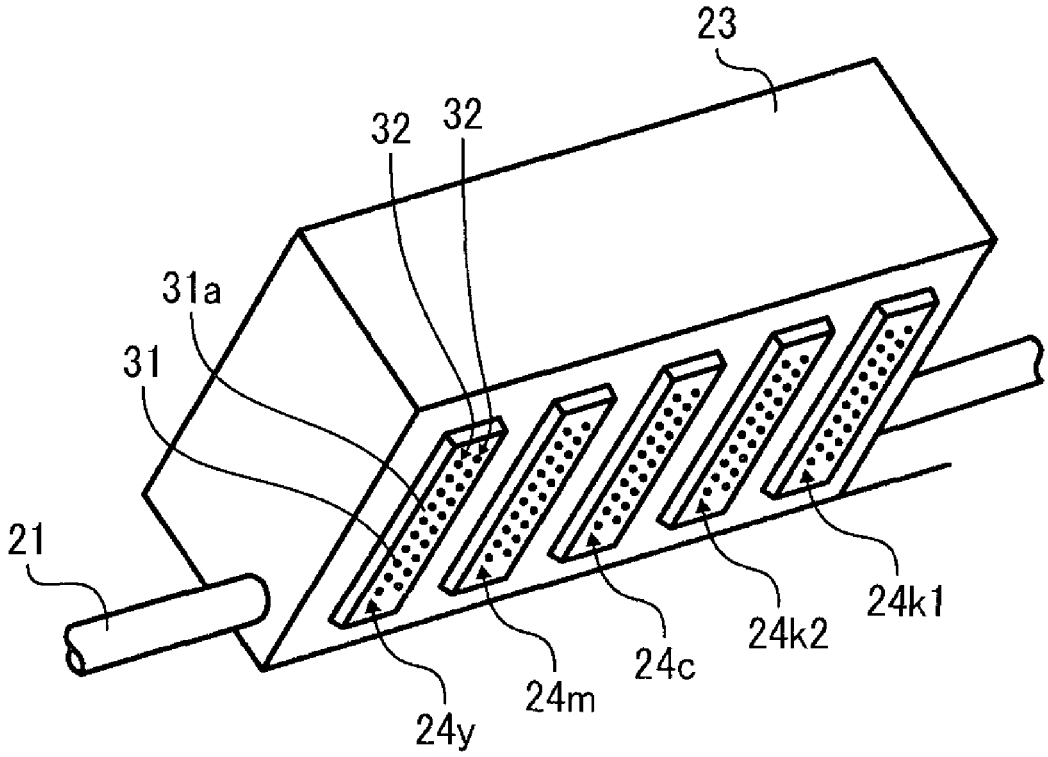
FIG. 6 illustrates a perspective view of a carriage of the printing section, which is viewed from the bottom side.

FIG. 3 illustrates a schematic configuration of an image forming apparatus 1 according to an exemplary, embodiment. FIG. 4 illustrates a front view of the image forming apparatus 1 of FIG. 3. FIG. 5 illustrates a perspective view of a recording unit of the image forming apparatus 1 of FIG. 3. FIG. 6 illustrates a perspective view of a carriage of the image forming apparatus 1 of FIG. 3, viewed from a bottom side of the carriage.

The image forming apparatus 1 may be a copier, but not limited thereto. The image forming apparatus 1 includes an image scanning unit 2, an image forming unit 3, and a sheet cassette 4, for example. The image scanning unit 2 scans a document image. The image forming unit 3 forms an image on a recording medium, such as a transfer sheet P. The sheet cassette 4 feeds the transfer sheet P to the image forming unit 3. The transfer sheet P, stored in the sheet cassette 4, is fed by a sheet feed roller 5 and a separation pad 6 one by one to a printing section 10 via a sheet transport path 7 so that an given image is recorded on the transfer sheet P. Then, the transfer sheet P having the image is ejected through a sheet ejection path 8 and stacked on a sheet stack 9.

As illustrated in FIG. 5, the printing section 10 includes a guide rod 21, a guide stay, a carriage 23, a main motor 27, a drive pulley 28, a driven pulley 29, and a timing belt 30, for example. The carriage 23 is slidably supported on the guide rod 21 and the guide stay to move the carriage 23 in a main scanning direction. The timing belt 30 is extended by the drive pulley 28 and the driven pulley 29. When the main motor 27 drives the drive pulley 28, the timing belt 30 travels in a given direction, by which the carriage 23 can be moved in the main scanning direction.

The carriage 23 includes recording heads 24*k* (24*k*1, 24*k*2), 24*c*, 24*m*, 24*y*, and a sub-tank 25 corresponded to each of the recording heads 24*k*, 24*c*, 24*m*, and 24*y*, for example. Each of the recording heads 24*k*, 24*c*, 24*m*, and 24*y* includes a liquid jetting head to respectively jet black (K) ink, cyan (C) ink, magenta (M) ink, and yellow (Y) ink, and the sub-tank 25 stores a given volume of ink to be supplied to each of the recording heads 24*k*, 24*c*, 24*m*, and 24*y*. Because the recording heads 24*k*, 24*c*, 24*m*, and 24*y* have a similar configuration one to another except color, these recording heads may be referred to as the recording head 24. Although the recording head for black color includes two recording heads 24*k*1 and 24*k*2 in FIG. 5, the recording head for black color may be set to one recording head.

As illustrated in FIG. 6, the recording head 24 includes a nozzle face 31*a*, in which a plurality of nozzles 31 are arrayed in two rows, for example, to jet liquid droplet(s). Each of the rows may be referred to as a nozzle array 32. The nozzle array 32 is aligned in a direction perpendicular to the main scanning direction (or a moving direction of the carriage 23). The carriage 23 faces its nozzle face 31*a* to a downward direction, which faces the transfer sheet P.

The image forming apparatus 1 further includes an ink cartridge 26, which is a main tank to supply ink to the sub-tank 25 connected to the recording head 24. The ink cartridge 26 can be detachably mountable to the image forming apparatus 1.

The recording head 24 may be selected from different types of liquid jetting heads. Such a liquid jetting head may typically include nozzle orifices to jet liquid droplets having diameters of from several micrometers to tens of micrometers, a chamber in connection with the orifices, and a vibration plate forming a wall surface of the chamber.

For example, such a liquid jetting head includes a piezoelectric actuator, such as a piezoelectric element, to apply pressure to liquid in the chamber via the vibration plate so as to jet liquid droplets.

Alternatively, another liquid jetting head includes a thermal actuator to apply pressure to the liquid in the chamber. Such a thermal actuator uses an electricity-to-heat conversion element to generate film boiling and thus a phase change of the liquid causes a jetting of liquid droplets.

Still another liquid jetting head includes an electrostatic force actuator to apply pressure to liquid in the chamber having a vibration plate and an electrode. The volume of the chamber can be changed by displacing the vibration plate using electrostatic force generated between the vibration plate and the electrode so as to jet liquid droplets.

The image forming apparatus 1 further includes a transport belt 35, extended by a drive roller 36 and a driven roller 37, under the carriage 23. The transport belt 35, which may be an endless belt, transports the transfer sheet P by adhering the transfer sheet P on the transport belt 35 with electrostatic force. When the transport belt 35 travels in a given direction by rotating the roller 36 and the driven roller 37, the transfer sheet P can be transported in a direction perpendicular to the main scanning direction. Further, a charge roller 33 is contacted to the transport belt 35 so that the charge roller 33 rotates with such a traveling movement of the transport belt 35. The rotating charge roller 33 charges the transport belt 35.

As illustrated in FIGS. 4 and 5, the image forming apparatus 1 further includes a head refreshing unit 38 at one end side of the main scanning direction of the carriage 23, and a dummy jetting unit 39 at the other end side of the main scanning direction of the carriage 23. The head refreshing unit 38 is used to maintain or refresh a condition of the nozzles 31 on the recording head 24. The dummy jetting unit 39 is used to jet some ink without conducting an actual image forming.

The head refreshing unit 38 includes a plurality of cap members 41, a wiping blade 42, and a jetted ink receiver 43, for example. The cap members 41 may include a suction cap 41*a* and three moisturizing caps 42*b*, for example. The cap members 41 (or the suction cap 41*a* and the moisturizing caps 42*b*) cap the nozzle face 31*a* of the recording head 24. The wiping blade 42 wipes the nozzle face 31*a* of the recording head 24. The suction cap 41*a* is connected to a suction pump 45, which may be a tube pump, for example. Ink suctioned by the suction cap 41*a* is ejected to a waste liquid tank 40 via the suction pump 45 and a waste liquid tube 46. The waste liquid tank 40, storing the waste ink, may be disposed under the suction cap 41*a*. Further, the dummy jetting unit 39 may include four openings 39*a*.

Figure 7:
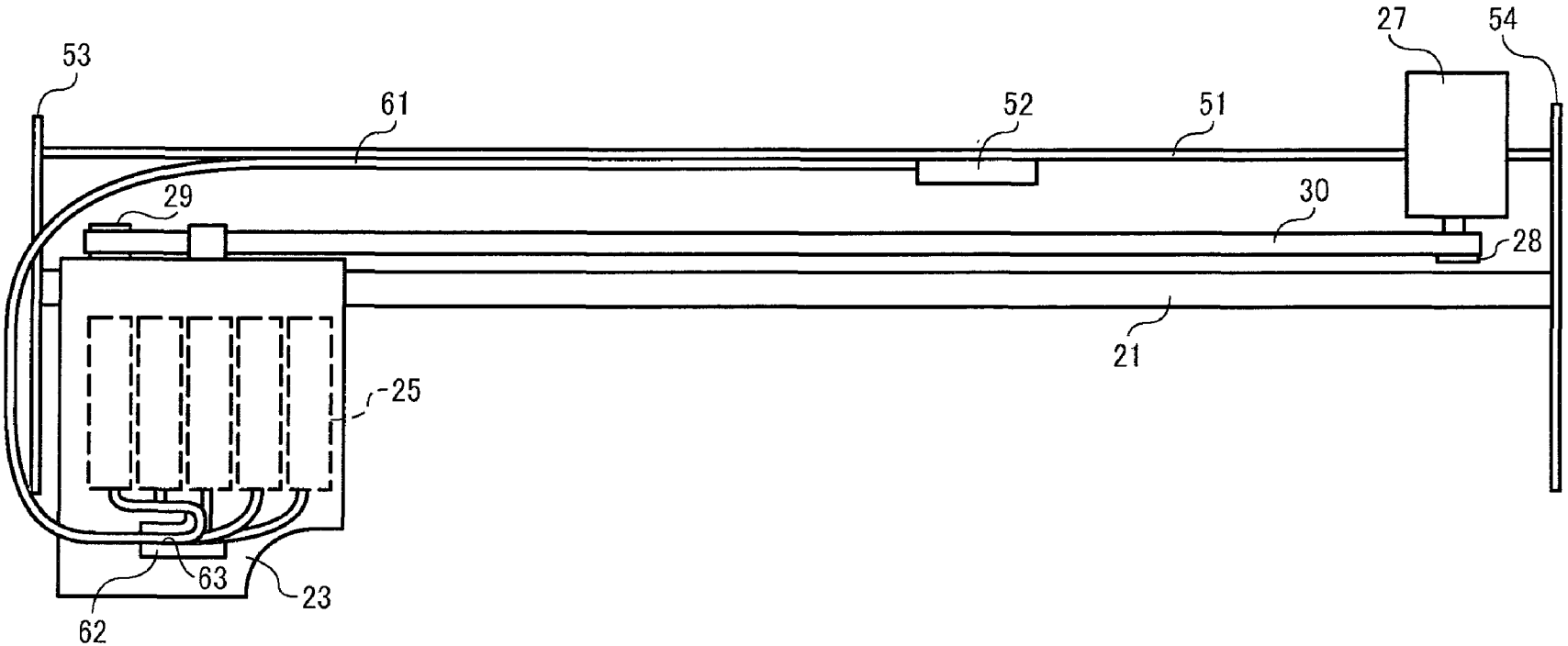
FIG. 7 illustrates a plan view of an image forming engine unit, in which ink supply route is included.
Figure 8:
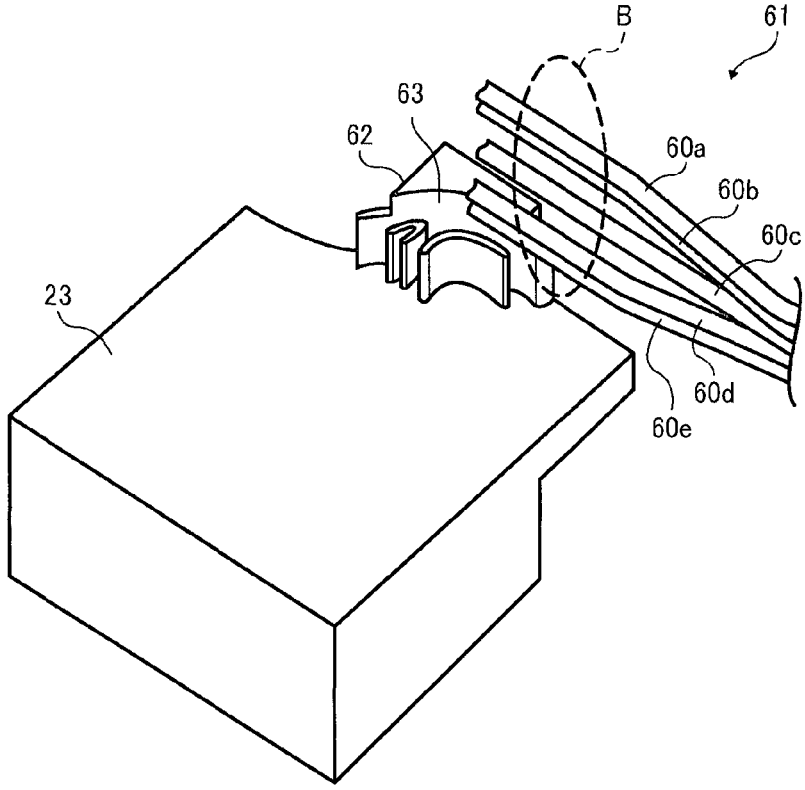
FIG. 8 illustrates a perspective view of a tube fixing unit of the carriage.
Figure 9:
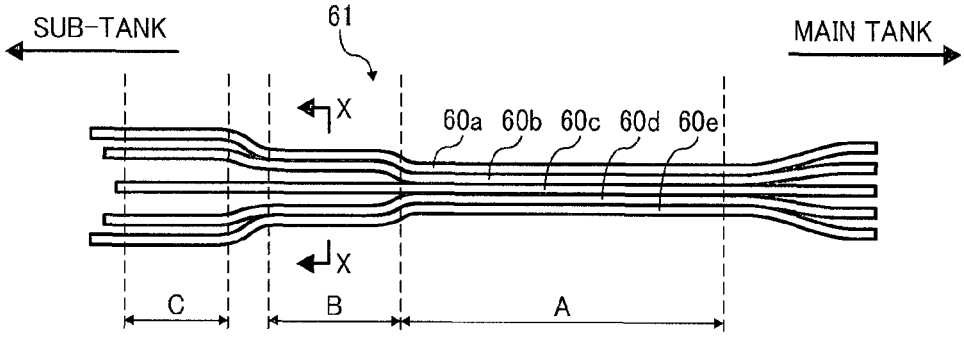
FIG. 9 illustrates a schematic view of a supply tube band according to an exemplary embodiment.
Figure 10:
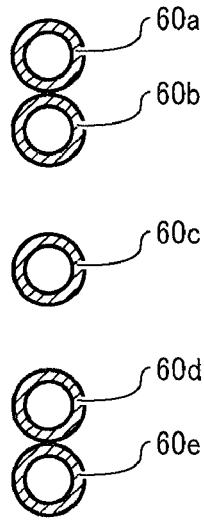
FIG. 10 illustrates a cross-sectional view of the supply tube band cut along a X-X line in FIG. 9.

A description is given of an ink supply route in the image forming apparatus 1 with reference to FIGS. 7 to 10. FIG. 7 illustrates a plan view of an image forming engine unit. FIG. 8 illustrates a perspective view of a tube fixing unit 62 of the carriage 23. FIG. 9 illustrates a supply tube band 61 according to an exemplary embodiment. FIG. 10 illustrates a cross-sectional view of the supply tube band 61 cut along a X-X line in FIG. 9.

As illustrated in FIG. 9, the supply tube band 61 includes a plurality of supply tubes 60 having a given flexibility. In this disclosure, the supply tube band 61 includes five supply tubes 60 (60*a* to 60*e*), but the number of supply tubes 60 is not limited thereto. One end of the supply tubes 60*a* to 60*e* are connected to a supply pump provided to the ink cartridge 26. As illustrated in FIG. 7, the supply tube band 61 may be routed from a downside of a housing of the image forming apparatus 1 to a rear plate 51, at which the supply tube band 61 is supported by a supporter 52. The supply tube band 61 is further routed along the rear plate 51.

The carriage 23, slidably movable on the guide rod 21 extending between side plates 53 and 54, includes a tube fixing unit 62 on a face of the carriage 23 as illustrated in FIG. 8. The tube fixing unit 62 includes a groove 63, which may be a slit-like shape, for example. One end side of the supply tube band 61 can be fit in the groove 63 by applying a pressure to the supply tube band 61 for fitting, and then the supply tubes 60 can be connected to the sub-tank(s) 25 provided for each of color.

As illustrated in FIG. 9, the supply tubes 60*a* to 60*e*, having a given flexibility and configuring the supply tube band 61, are connecting the ink cartridge 26 (used as a main tank) and the sub-tank 25. In an exemplary embodiment, the supply tubes 60*a* to 60*e* are fused in different manners at areas A, B, and C as illustrated in FIG. 9. Specifically, the supply tubes 60*a* to 60*e* are fused side-by-side together at the area A in a band-shape, wherein the area A is between the ink cartridge 26 and the tube fixing unit 62 of the carriage 23. In the area B, which corresponds to a position of the groove 63 of the tube fixing unit 62 on the carriage 23, a maximum of two of the supply tubes 60 are fused together. For example, the supply tubes 60*a* and 60*b* are fused together, and the supply tubes 60*d* and 60*e* are fused together in the area B. In the area C, which corresponds to a position between the tube fixing unit 62 and the sub-tank 25, the supply tubes 60*a* to 60*e* are not fused together but separated. In the area C, the end portion of the supply tubes 60*a* to 60*e* are connected to the sub-tank(s) 25. In general, tubes may be bonded together with known methods, such as using adhesives. In an exemplary embodiment, the supply tubes 60 may be bonded together by a method of fusion bonding, in which parts to be bonded together are heated and melted by know methods, such as ultrasonic wave but not limited thereto, and then welded together, by which the supply tubes 60 can be fused together. Such fusion bonding method may not require or intervene additional materials, such as adhesives, between fused parts, which may be preferable from a viewpoint of material saving, cost reduction, process simplification or the like.

As illustrated in FIG. 10, the supply tubes 60*a* and 60*b* are fused together, the supply tubes 60*d* and 60*e* are fused together, and the supply tube 60*c* is not fused to other tubes in the area B. When the supply tube band 61 is fitted in the groove 63 of the tube fixing unit 62, the supply tubes 60*a* and 60*b* come to an upper position, the supply tube 60*d* and 60*e* come to a lower position, and the supply tubes 60*c* comes to a middle position.

The supply tube band 61 can be pressingly fit in the groove 63 of the tube fixing unit 62 of the carriage 23 as below. As illustrated in FIG. 8, the fused supply tubes 60*e* and 60*d* are pressingly fit in the groove 63 at first, then the supply tube 60*c* is pressingly fit in the groove 63, and lastly the fused supply tubes 60*b* and 60*a* are pressingly fit in the groove 63.

Figure 11:
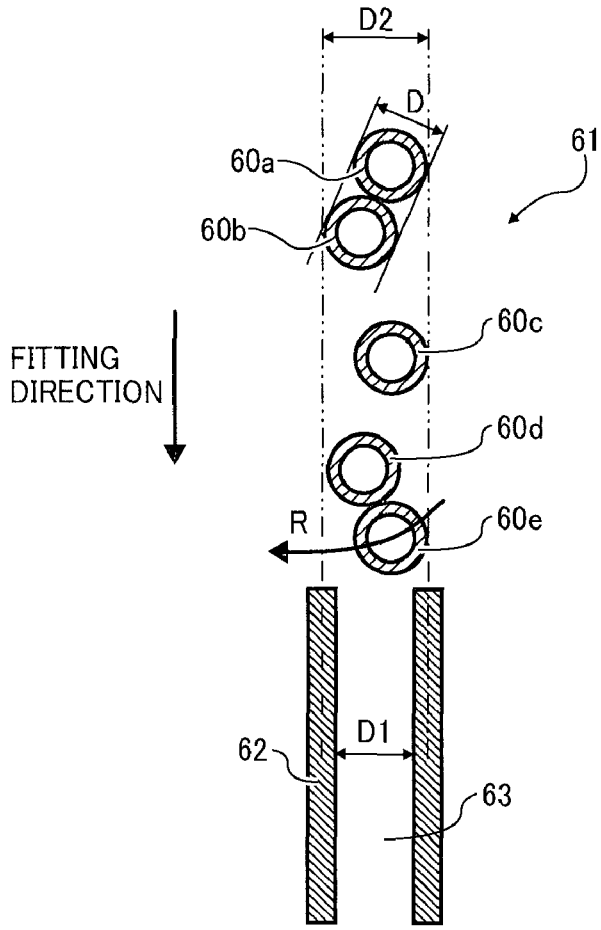
FIG. 11 illustrates a cross-sectional view of the supply tube, in which some supply tubes are deviated from other supply tubes due to a fused condition.

As above described, the number of fused tubes is "two" at most for the supply tubes 60 to be fitted in the groove 63 of the tube fixing unit 62 (see the area B). Accordingly, the outer diameter size of the two-fused supply tubes 60 becomes same as the outer diameter D of one supply tube 60 regardless of fusion bonding precision. Accordingly, for example, even if an overall width D2 of the five supply tubes 60 becomes greater than a width D1 of the groove 63 of the tube fixing unit 62 (D2>D1), the fused tubes 60*e* and 60*d* can be fit in the groove 63 smoothly by changing a direction of the supply tubes 60*e* and 60*d* in a direction shown by an arrow R as illustrated in FIG. 11.

As above described, a plurality of supply tubes 60 are fused together as the integrated band-shape tubes between the main tank 26 and the carriage 23, and a maximum of two of the supply tubes 60 are fused together at a position to be fit in the groove 63 of the tube fixing unit 62 (see the area B). With such a configuration, the supply tubes 60 may not be scratched or damaged by a corner of the tube fixing unit 62 when the supply tubes 60 are fit in the groove 63, and an assembly of the supply tubes 60 can be performed efficiently because of such fused configuration.

In the above-described embodiment, the number of the supply tubes 60 is odd number such as five. In such an odd number case, the supply tubes 60 can be effectively fit in the tube fixing unit 62 as below. For example, because the two-fused supply tubes 60*a* and 60*b* can be fit in the tube fixing unit 62 of the carriage 23 at the upper position, the supply tubes 60 may be fit firmly (or may not be come off easily from the tube fixing unit 62) compared to a case that one supply tube 60 is fit in the upper position of the tube fixing unit 62. Further, because the two-fused supply tubes 60*d* and 60*e* can be fit in the tube fixing unit 62 of the carriage 23 at the lower position, the supply tubes 60 can be fit firmly and easily in the tube fixing unit 62 compared to a case that one supply tube 60 is fit at the lower position.

If the number of the supply tubes 60 is even number, such as four, two adjacent supply tubes 60 can be fused together and the fused two adjacent supply tubes 60 can be fitted in the tube fixing unit 62 of the carriage 23 as similar to the above described embodiment having the odd number supply tubes 60.

Further, a color of the supply tube(s) 60 that runs to anyone of an uppermost portion and a lowermost position may have a different color compared to other supply tubes 60, by which the supply tubes 60 can be easily fit in the tube fixing unit 62 in a correct direction because a user can recognize the colored supply tube 60 easily. Such coloring method of the supply tubes 60 can be effectively prevent a wrong direction fitting of the supply tubes 60.

With such a colored tube configuration, the supply tubes 60 can be fit in a correct direction easily, by which an assembly of the supply tubes 60 can be performed efficiently. In such a configuration, the color of the supply tubes 60 not used for indicating a fitting direction can be set to a same color, by which a manufacturing cost of the supply tubes 60 can be reduced.

In the above described embodiment, a plurality of supply tubes 60 are fused together in the integrated band-shape between the main tank 26 and the carriage 23, and a maximum of two of the supply tubes 60 are fused together at a position to be fit in the groove 63 of the tube fixing unit 62. With such a configuration, the supply tubes 60 may not be scratched or damaged by a corner of the tube fixing unit 62 when the supply tubes 60 are fit in the groove 63, and an assembly of the supply tubes 60 can be performed efficiently because of such welded configuration.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. An image forming apparatus, comprising:

a carriage including a plurality of recording heads that jet liquid droplets of a plurality of colored ink;

a plurality of sub-tanks configured to supply the plurality of recording heads with a corresponding colored ink;

a main tank configured to supply the corresponding colored ink to each of the sub-tanks; and a plurality of supply tubes that connect the main tank and the sub-tanks, the plurality of supply tubes being fused in a band shape at a position between the main tank and the carriage, a maximum of two of the supply tubes being fused together at a position corresponding to a groove of a tube fixing unit provided to the carriage.

2. The image forming apparatus according claim 1, wherein, when the supply tubes are fitted in the groove of the tube fixing unit, the two supply tubes that are fused together are positioned at an uppermost position in the groove.

3. The image forming apparatus according claim 1, wherein there are an odd number of the supply tubes, and the two supply tubes that are fused together are positioned at one of an uppermost position and a lowermost position when the supply tubes are fitted in the groove of the tube fixing unit.

4. The image forming apparatus according claim 3, wherein there are an odd number of the supply tubes numbering at least five, and the two supply tubes that are fused together are positioned at both an uppermost position and a lowermost position when the supply tubes are fitted in the groove of the tube fixing unit.

5. The image forming apparatus according claim 3, wherein a color of the supply tube running to one of an uppermost position and a lowermost position in the groove of the tube fixing unit and colors of other supply tubes not running to one of the uppermost position and the lowermost position in the groove of the tube fixing unit are different colors.

6. The image forming apparatus according claim 1, wherein there are an even number of the supply tubes, and adjacent supply tubes are fused together in pairs of two tubes.

7. The image forming apparatus according claim 6, wherein there are an even number of the supply tubes include numbering at least four, the supply tubes are fused together in pairs of two tubes, and the supply tubes are fitted in the groove of the tube fixing unit.

8. The image forming apparatus according claim 6, wherein a color of the supply tube running to any one of an uppermost position and a lowermost position in the groove of the tube fixing unit and colors of other supply tubes not running to one of the uppermost position and the lowermost position in the groove of the tube fixing unit are different colors.

9. The image forming apparatus according claim 1, wherein the plurality of supply tubes are pressingly fitted in the groove of the tube fixing unit of the carriage.

* * * * *